United States Patent [19]

Schade, II et al.

[11] 4,190,148

[45] Feb. 26, 1980

[54] CIGARETTE AND CIGARETTE LIGHTER CASE AND COVER

[76] Inventors: Palmer W. Schade, II; George Spector, both of 3615 Woolworth Bldg., 233 Broadway, New York, N.Y. 10007

[21] Appl. No.: 733,846

[22] Filed: Oct. 19, 1976

[51] Int. Cl.[2] ..... A24F 15/00; B65D 85/10; A45C 15/00; A45C 1/04

[52] U.S. Cl. ..... 206/89; 206/101; 206/38; 224/194; 224/196; 224/199

[58] Field of Search ..... 206/85, 89, 38, 101, 206/92, 94, 87; 224/5 R, 25 R; 24/3 R, 3 L

[56] References Cited

U.S. PATENT DOCUMENTS

| | | | |
|---|---|---|---|
| 1,899,795 | 2/1933 | Davis et al. | 224/25 R |
| 1,913,142 | 6/1933 | Ondricer | 206/101 |
| 2,460,427 | 2/1949 | Musselman et al. | 206/89 |
| 2,536,725 | 1/1951 | Cleveland | 206/101 |
| 2,547,620 | 4/1951 | Capano | 206/94 |
| 2,563,749 | 8/1951 | Rose et al. | 24/3 L |
| 3,199,754 | 8/1965 | Sorensen | 224/5 R |

*Primary Examiner*—William T. Dixson, Jr.

[57] ABSTRACT

A case with removable cover the case being designed to contain both a pack of cigarettes and also a pocket lighter so that a person has both handy when needed to smoke a cigarette; the case also including a clip on its rear side so to be supported from a person's garment.

2 Claims, 4 Drawing Figures

CIGARETTE AND CIGARETTE LIGHTER CASE AND COVER

This invention relates generally to cigarette smoking accessories. More specifically it relates to cigarette cases.

A principal object of the present invention is to provide a case for holding a pack of cigarettes and which additionally also holds a cigarette pocket lighter so that both are handily available together at a time when both are handily available together at a time when both are necessary for a person who wishes to smoke a cigarette.

Another object is to provide a case which includes a removable cover that encloses both the cigarette pack and the lighter so to protect them from rain when the case is exposed out-of-doors.

Yet another object is to provide a cigarette and cigarette lighter case which includes a clip so to be readily attachable to a person's garment such as a belt or shirt, so that it can be conveniently carried if a pocket is not available.

Other objects are to provide a CIGARETTE AND CIGARETTE LIGHTER CASE AND COVER which is simple in design, inexpensive to manufacture, rugged in construction, easy to use and efficient in operation.

These and other objects will be readily evident upon a study of the following specification and the accompanying drawing wherein.

Figure 1:
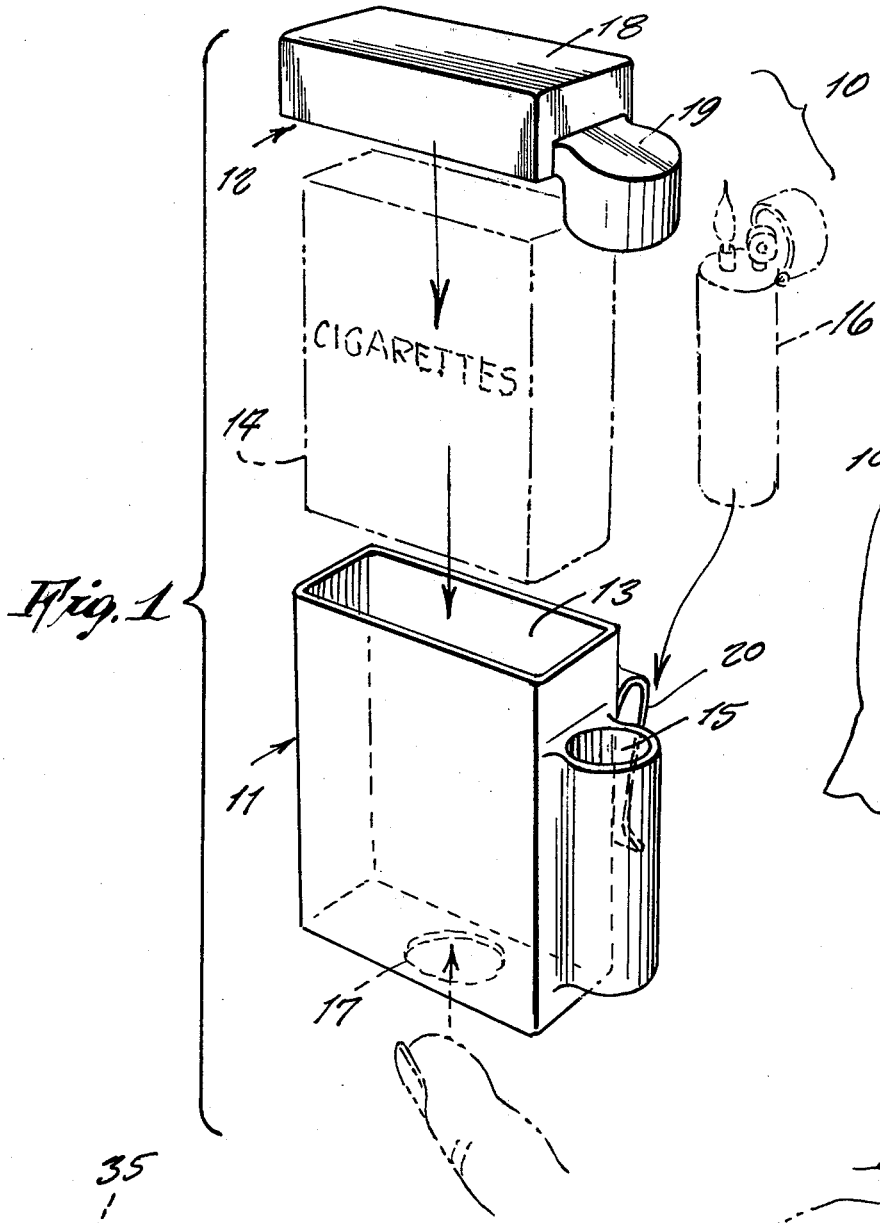
FIG. 1 is a perspective view of the invention, shown with cover removed from the case.
Figure 2:
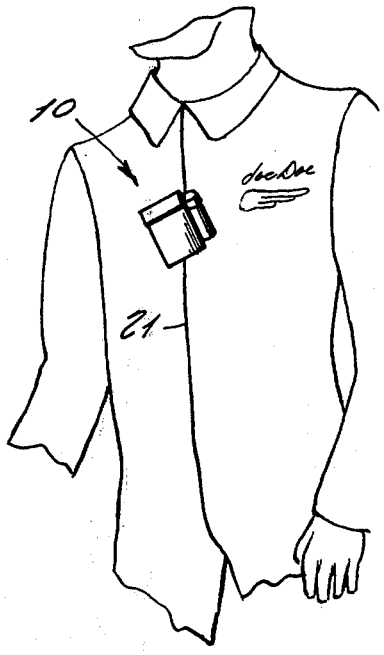
FIG. 2 shows the device being worn on a garment.

Referring now to the drawing in greater detail, and more particularly to FIGS. 1 and 2, thereof, at the present time, the reference numeral 10 represents a device according to the present invention wherein there is a case 11 and a removable cover 12, both of which may be made of a suitable material such as molded hard plastic, metal or other substance. The case includes a cavity 13 of a size for receiving a pack of cigarettes 14. The case also includes a cavity 15 of size and shape adaptable to receive a cigarette lighter 16. The cavities may be either equal to the height of the cigarette pack and lighter in which case there is a small finger receiving opening 17 on the bottom of the cavities so to allow pushing these articles above the upper edge of the case in order to be grasped by the hand then removed from the cavities; or alternately these articles may be taller than the cavities so to be readily grasped.

The cover 12 is shaped so to include cap portion 18 and 19 for closing both the cavities.

A clip 20 joined on a rear side of the case permits supporting the device either from a belt or along a vertical edge 21 of any garment such as a shirt, coat or the like, as shown in FIG. 2.

Figure 3:
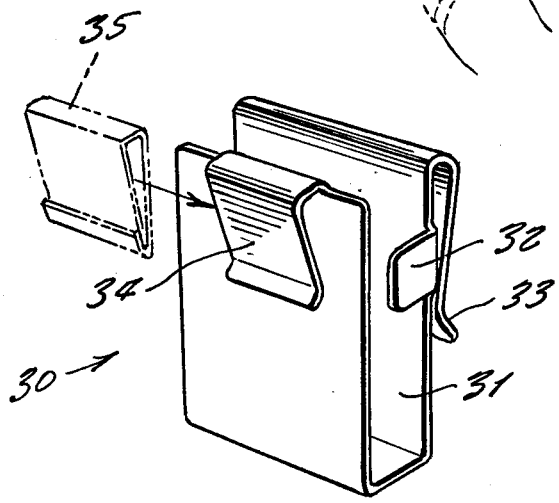
FIG. 3 is a perspective rear view of a modified design of the invention.

In FIG. 3, a modified design of device 30 is shown that is formed of bent up sheet metal and includes a U-shaped pocket 31 for clipping the cigarette pack. Tabs 32 along opposite side edges of the pocket prevent the pack from falling out sidewardly therefrom. A clip 33 is formed on one end edge of the U-shaped packet for clipping on a belt or garment. A bent over clip 34 formed at the opposite end edge of the U-shaped pocket serves to hold a conventional book of matches 35. Thus the product is formed from a single sheet of metal that is bent into a specific shape.

Figure 4:
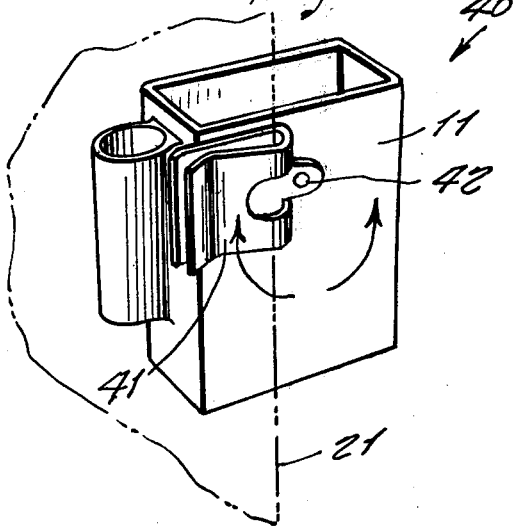
FIG. 4 is a similar view of still another modified design thereof.

In FIG. 4, another design of device 40 includes a case 11 as shown in FIG. 1 for holding a cigarette lighter and cigarette pack. However, in this design, a clip 41 is pivotally secured to a rear of the case by means of pivot pin 42. This design permits the case to hang truly vertically from a garment edge 21 as shown in FIG. 4, instead being tilted as shown in FIG. 2, so that the cover, cigarette pack and lighter are more sure not to fall out.

Thus different designs of the invention are provided.

While various changes may be made in the detail construction, it is understood that such changes will be within the spirit and scope of the present invention, as is defined by the appended claims.

What is claimed is:

1. A cigarette and cigarette lighter case assembly, comprising a case with an open end and a removable cover, said case having a cavity for receiving a pack of cigarettes and a separable cavity for receiving a cigarette lighter, said cover being adapted to fit over said open end and close simultaneously said openings to both said cavities, in combination with a two pronged U-shaped clip pivotally secured to a rear side of said case by pivot means whereby both said pivot and said clip are spaced from said open end and rear side respectively to permit closure of said case by said cover, said clip being pivotable to a position whereby the cigarette pack and lighter will be vertical when said case is mounted on a vertical edge of users garment with both said prongs engaging said garment, said clip being aligned parallel to a plane passing through the centers of said cavities.

2. A case as in claim 1, including means facillitating removal of said pack and lighter spaced from said openings.

* * * * *